US008826471B1

(12) United States Patent
Maddox

(10) Patent No.: US 8,826,471 B1
(45) Date of Patent: Sep. 9, 2014

(54) DISPOSABLE SHOWER CURTAIN LINER DEVICE

(71) Applicant: Bessie Maddox, Toledo, OH (US)

(72) Inventor: Bessie Maddox, Toledo, OH (US)

( * ) Notice: Subject to any disclaimer, the term of this patent is extended or adjusted under 35 U.S.C. 154(b) by 0 days.

(21) Appl. No.: 14/033,092

(22) Filed: Sep. 20, 2013

(51) Int. Cl.
*A47K 3/08* (2006.01)
*B65D 83/08* (2006.01)
*A47K 3/38* (2006.01)

(52) U.S. Cl.
CPC ..... *A47K 3/38* (2013.01); *B65D 83/0805* (2013.01)
USPC ..... 4/558; 4/557; 4/607; 4/608; 4/580

(58) Field of Classification Search
CPC ..... A47K 3/38
USPC ..... 4/557, 558, 607, 608
See application file for complete search history.

(56) References Cited

U.S. PATENT DOCUMENTS

| | | | |
|---|---|---|---|
| 5,003,647 | A | 4/1991 | Williams |
| 2006/0026747 | A1 | 2/2006 | Prabhakar |
| 2009/0071613 | A1 | 3/2009 | Galbiati |

*Primary Examiner* — Tuan N Nguyen
(74) *Attorney, Agent, or Firm* — Benjamin F. Williams

(57) ABSTRACT

A disposable shower curtain liner device that includes a plurality of flexible polymeric sheet members disposed dispensable from a housing, each of said plurality of sheet members including a pair of adhesive strips and a plurality of magnets disposed upon a first surface of said sheet member for releasable attachment of the sheet member to a bathroom surface whereby contact between a user and a bathroom surface is preventable.

4 Claims, 3 Drawing Sheets

DISPOSABLE SHOWER CURTAIN LINER DEVICE

BACKGROUND OF THE INVENTION

Various types of shower curtain devices are known in the prior art. However, what is needed is a disposable shower curtain liner device that includes a plurality of flexible polymeric sheet members disposed dispensable from a housing, each of said plurality of sheet members including a pair of adhesive strips and a plurality of magnets disposed upon a first surface of said sheet member for releasable attachment of the sheet member to a bathroom surface whereby contact between a user and said bathroom surface is preventable.

FIELD OF THE INVENTION

The present invention relates to a disposable shower curtain liner device, and more particularly, to a disposable shower curtain liner device that includes a plurality of flexible polymeric sheet members disposed dispensable from a housing, each of said plurality of sheet members including a pair of adhesive strips and a plurality of magnets disposed upon a first surface of said sheet member for releasable attachment of the sheet member to a bathroom surface whereby contact between a user and said bathroom surface is preventable.

SUMMARY OF THE INVENTION

The general purpose of the disposable shower curtain liner device, described subsequently in greater detail, is to provide a disposable shower curtain liner device which has many novel features that result in a disposable shower curtain liner device which is not anticipated, rendered obvious, suggested, or even implied by prior art, either alone or in combination thereof.

The present invention has been devised to enable increased sanitary and hygienic conditions in an extant bathroom. In shared or common bathrooms, and especially in developing nations or in regions effected by a natural disaster, unhygienic conditions can prevail in bathrooms as frequent use of a particular bathroom by a plurality of people is necessitated. The present invention releasably attaches to a bathroom surface, such as a shower curtain, shower door, a tiled surface, a stone surface, a glass surface, a polymeric surface, a metal surface, or other waterproof surface typical of bathrooms in the present age, to prevent contact between a user and said surface when showering, bathing, or washing.

The present disposable shower curtain liner device, therefore, includes a plurality of flexible, waterproof polymeric sheet members disposed dispensable from a housing. Each of the plurality of sheet members includes a first surface for releasable attachment to said bathroom surface. A pair of adhesive strips is disposed on the first surface, each of the pair of adhesive strips disposed in parallel proximal an opposite edge of the sheet member.

A pair of release members is disposed covering the pair of adhesive strips. The pair of release members is removable to uncover a water resistant adhesive disposed upon the pair of adhesive strips whereby the sheet member is releasably securable to said bathroom surface. The water resistant adhesive is releasably securable to bathroom surfaces including glass, plastic, polymers, stone, clay, tiles, and other such waterproof surfaces commonly used in bathrooms in the present age.

A plurality of magnets is disposed upon the first surface of each of the plurality of sheet members whereby each of the plurality of sheet members is releasably securable to a metal surface, such as a cast iron tub, or other metal or metallic surface disposed in a bathroom.

Each of the plurality of sheet members is disposed within the housing and is removable therefrom for expedient extraction through an opening disposed in the housing. Removal of an uppermost one of the plurality of sheet members from the housing effects repositioning of an underlying one of the plurality of sheet members for subsequent removal, as desired.

Each of the plurality of sheet members is contemplated to be folded within the housing with at least one edge interlaced with an underlying one of the plurality of sheet members. Withdrawal, therefore, of an uppermost one of the plurality of sheet members form the housing repositions an underlying one of the plurality of sheet members suitable for convenient extraction from the housing.

Each of the plurality of magnets may releasably engage each of the plurality of sheet members together for convenient extraction of each of the plurality of sheet members from the housing. Removal of an uppermost one of the plurality of sheet members from the housing may, therefore, effect repositioning of an underlying one of the plurality of sheet members by use of the magnetic force effected between adjacent sheet members folded within the housing.

A roll of sheet members is further contemplated as a part of this invention whereby the plurality of sheet members is unrollable from within the housing, each of said plurality of sheet members separable, as desired, when unrolling one or more sheet members from the housing.

Each of the plurality of sheet members may thus be extracted from the housing for releasable attachment to an extant bathroom surface whereby contact of a user with said bathroom surface is preventable. Disposal of each of the plurality of sheet members is thence effected, when desired, without a user having to contact an extant is bathroom surface which may be contaminated with microorganisms transmissible between people sharing a bathroom.

Thus has been broadly outlined the more important features of the present disposable shower curtain liner device so that the detailed description thereof that follows may be better understood and in order that the present contribution to the art may be better appreciated.

Objects of the present disposable shower curtain liner device, along with various novel features that characterize the invention are particularly pointed out in the claims forming a part of this disclosure. For better understanding of the disposable shower curtain liner device, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
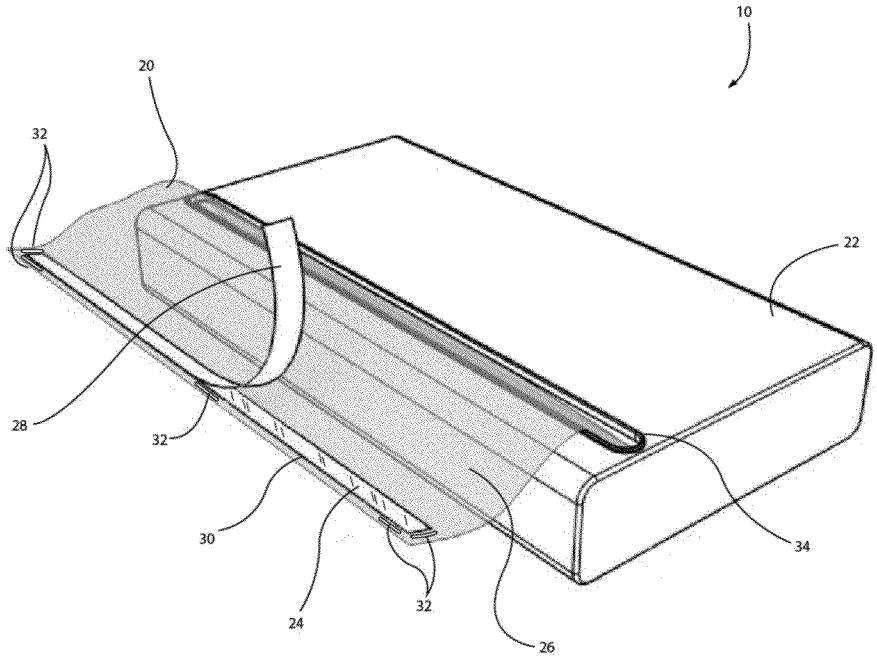
FIG. 1 is an isometric view of a sheet member ready for extraction from a housing.
Figure 2:
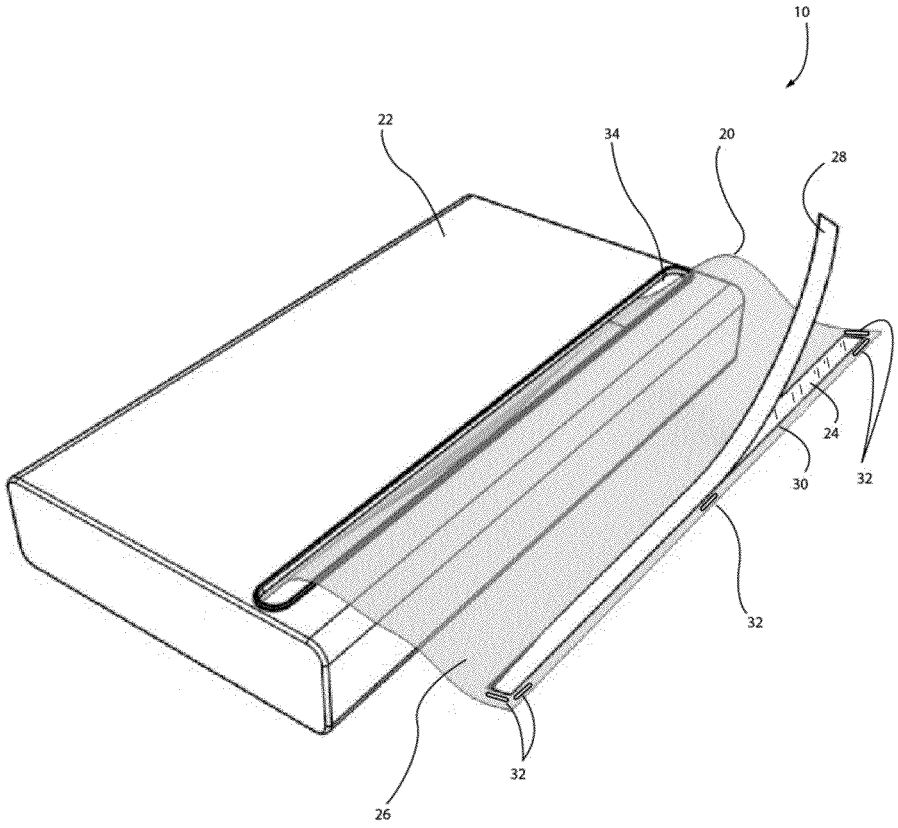
FIG. 2 is an isometric view of a sheet member ready for extraction from a housing.
Figure 3:
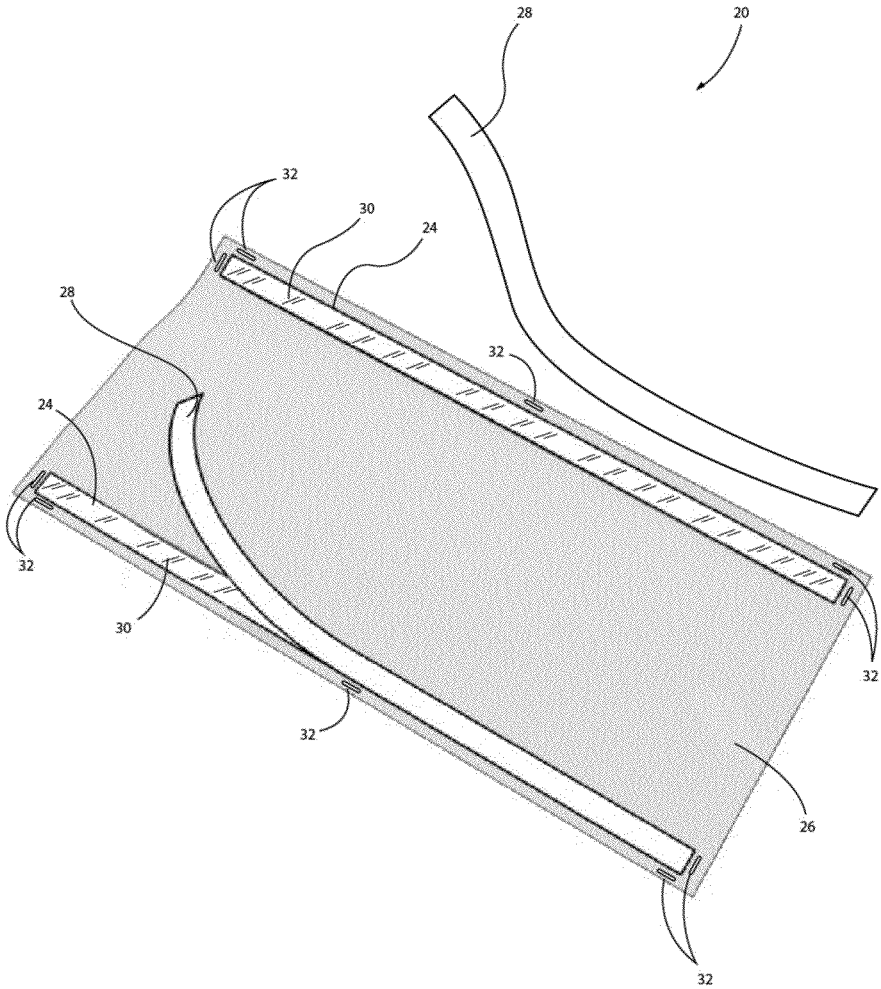
FIG. 3 is a view of a first surface of a sheet member.

With reference now to the drawings, and in particular FIGS. 1 through 3 thereof, example of the instant disposable shower curtain liner device employing the principles and concepts of the present disposable shower curtain liner device and generally designated by the reference number 10 will be described.

Referring to FIGS. 1 through 3 a preferred embodiment of the present disposable shower curtain liner device 10 is illustrated.

The present disposable shower curtain liner device 10 has been devised to enable expedient attachment of a sheet member 20 to an extant bathroom surface, tiled surface, shower door, shower curtain, or other waterproof barrier disposed in bathrooms, to prevent contact with said surface or barrier and enable expedient disposal after usage whereby use of shared or common bathrooms is rendered more hygienic between users and any particular user is prevented from contacting bathroom surfaces or barriers which may be host to bacteria, fungi, or other microorganisms transmissible between people.

The present disposable shower curtain liner device 10, therefore, includes a plurality of polymeric, waterproof and flexible sheet members 20 readily dispensable from a housing 22. Each sheet member 20 includes a pair of adhesive strips 24 disposed in parallel on a first surface 26 of the sheet member 20, each of said pair of adhesive strips 24 disposed proximal an edge of said sheet member 20. Each of the pair of adhesive strips 24 is covered with a removable release member 28 which, when removed from covering each of the pair of adhesive strips 24 reveals a water resistant 30 adhesive by which the sheet member 20 is securable to a surface, including tile, plastic, rubber, stone, porcelain, vinyl, glass, Perspex, and other materials typical of bathroom surfaces and waterproof barriers common in the modern age.

For use with cast iron tubs, or other metal or metallic surfaces, a plurality of magnets 32 is included. Each of the plurality of magnets 32 is disposed upon the first surface 26 of the sheet member 20. The sheet member 20 is therefore releasably securable to metal surfaces, also, whereby the present invention 10 is usable with cast iron tubs, on stainless steel surface, and other metal or metallic surfaces. Each of the plurality of magnets 32 may be galvanized, or otherwise enclosed in a waterproof layer, to prevent rusting or corrosion.

The present disposable shower curtain liner device 10 includes a housing 22 from which the plurality of sheet members 20 is readily dispensable. The housing 22 includes an opening 34 through which an uppermost sheet member 20 is retrievable for use, as desired. Each of the plurality of sheet members 20 is disposed folded together in the housing 22, whereby removal of an uppermost sheet member 20 from the housing 22 positions a subsequent, second sheet member 20, with an edge disposed proximal the housing 22 opening 34 for immediate retrieval from the housing 22 when desired. Each of the plurality of sheet members 20 may be folded with an edge interpolated interior to the fold of an underlying sheet member 20, whereby removal of the overlying sheet member 20 from the housing 22 readily repositions the underlying sheet member 20 with an edge disposed protruding, or otherwise proximal to, the opening 34 of the housing 22.

Other arrangements of the plurality of sheet members 20 within the housing are contemplated to effect the repositioning of a sheet member 20 when an overlying sheet is member 20 is retrieved from the housing 22, including the use of the magnets to lift and reposition an underlying sheet member 20 when an overlying sheet member 20 is pulled from the housing 20, and, additionally, a roll of sheet members 20 is further contemplated whereby sheet members 20 are unspooled from the housing 22 and torn or otherwise separated from the roll for use, as desired.

What is claimed is:

1. A disposable shower curtain liner device for attachment to a shower curtain, door, or other bathroom surface, said disposable shower curtain liner device comprising a plurality of flexible, waterproof sheet members dispensable from a housing, each of said plurality of sheet members comprising:

a first surface;

a pair of adhesive strips disposed in parallel upon the first surface, each of said adhesive strips disposed proximal an edge of the sheet member;

a pair of release members, each of said pair of release members removably disposed covering each of the pair of adhesive strips;

a water resistant adhesive disposed upon each of the pair of adhesive strips, said water resistant adhesive exposed for attachment to a shower curtain or other bathroom surface when the respective release member is removed; and a plurality of magnets disposed upon the first surface, each of said plurality of magnets disposed to releasably secure the sheet member to a metal surface;

wherein the water resistant adhesive releasably secures the sheet member to any bathroom surface, including tile, vinyl, polymer, glass, stone, clay, rubber, iron, metal, and plastic, whereby the sheet member is removably secured to a bathroom surface to prevent direct contact of a user with said surface.

2. The disposable shower curtain liner device of claim 1 wherein each of the plurality of sheet members is dispensable from a housing, said housing including an opening from which an uppermost one of the plurality of sheet members is retrievable whereby removal of said uppermost one of the plurality of sheet members repositions an underlying one of the plurality of sheet members for ready retrieval from the housing.

3. The disposable shower curtain liner device of claim 2 wherein the plurality of magnets disposed on an overlying one of the plurality of sheet members releasably engages with the plurality of magnets of an underlying one of the plurality of sheet members whereby the removal of an overlying one of the plurality of sheet members from the housing effects the repositioning of an underlying one of the plurality of sheet members for subsequent retrieval from the housing.

4. The disposable shower curtain liner device of claim 2 wherein the plurality of sheet members is disposed upon a roll, each of said plurality of sheet members unrolled from the housing for use, as desired.

* * * * *